US006006833A

United States Patent [19]

Burleson et al.

[11] Patent Number: 6,006,833

[45] Date of Patent: Dec. 28, 1999

[54] METHOD FOR CREATING LEAK-TESTED PERFORATING GUN ASSEMBLIES

[75] Inventors: John D. Burleson; Justin L. Mason, both of Denton; Flint R. George, Flower Mound; Joseph A. Henke, Lewisville, all of Tex.

[73] Assignee: Halliburton Energy Services, Inc., Dallas, Tex.

[21] Appl. No.: 09/008,919

[22] Filed: Jan. 20, 1998

[51] Int. Cl.[6] ..... E21B 43/117

[52] U.S. Cl. ..... 166/250.08; 166/250.01; 166/297

[58] Field of Search ..... 166/250.08, 250.01, 166/297, 55.1, 298; 102/307; 175/4.6

[56] References Cited

U.S. PATENT DOCUMENTS 4,919,050 4/1990 Dobrinski et al. ..... 102/307

5,355,957 10/1994 Burelson et al. ..... 166/297

5,598,891 2/1997 Snider et al. ..... 166/308

5,603,379 2/1997 Henke et al. ..... 166/297

*Primary Examiner*—William Neuder

*Attorney, Agent, or Firm*—William M. Imwalle; Marlin R. Smith

[57] ABSTRACT

Methods are provided which permit pressure tested multiple perforating gun modules to be interconnected into gun assemblies, without disturbing any pressure-bearing seals of the modules. Prior to assembling the gun assembly, the seals of the modules are pressure tested. The pressure tested modules are then connected to each other without disconnecting or otherwise breaking any of the pressure-bearing seals of the modules.

22 Claims, 4 Drawing Sheets

METHOD FOR CREATING LEAK-TESTED PERFORATING GUN ASSEMBLIES

BACKGROUND OF THE INVENTION

During the process of perforating an oil or gas well, a perforating gun assembly has to be lowered into and positioned properly in the wellbore. Quite often, the gun assembly will have to spend some time prior to firing in a fluid-filled environment in the wellbore. If the gun system develops a leak which allows wellbore fluids to enter the gun system, several things could happen which are not desirable. The system could misfire altogether, only partially fire, fire low order and thereby damaging downhole equipment or becoming stuck, and so on. Therefore, it is important that a gun system have no leaks.

A typical perforating gun assembly consists of one or more perforating guns, as well as possibly comprising some spacer sections. If the zone to be perforated is longer than the amount which could be perforated with a single gun, then multiple perforating guns are connected together to create a perforating gun assembly of the desired length. Further, if there is more than one zone is to be perforated, and there is some distance between the zones to be perforated, spacer sections are inserted between the guns in the gun assembly. These spacer sections have detonation cord running from end to end, to transfer the ignition through the spacer section to the next component.

In order for the explosive transfer to occur from one section to the next in the gun assembly, an explosive transfer system is employed. This could be an overlap of detonating cord, the use of boosters either overlapped or end to end, or other known methods.

Typically there are seals (usually o-rings) at each point where the guns are connected together to prevent leaks and protect the inside of the gun system for wellbore fluids. It has been possible in the past to pressure test perforating guns and spacers prior to running into a wellbore. However, the length of test equipment was usually limited. In order to test the various portions of the gun assembly some type of temporary connection is made at the ends of the guns so that the guns may be externally pressure tested. At some time prior to running into the wellbore the temporary connection is disconnected so that the guns may be coupled together for running into the wellbore. Once these temporary connections are undone, the pressure test at that temporary connection point (now gun connection point) is void. When perforating guns are coupled together to run into the wellbore, this connection point between the guns would then be untested. If testing of this connection point is desired, the only option is to test at the well site, which is highly undesirable. The untested connections poise a much higher leak risk than the tested connections.

Therefore, it is an object of the invention to develop a system which would eliminate any untested connections within the gun assembly which could serve as leak paths that could damage the guns.

It is further an object of the invention to have a method and apparatus which would allow all required pressure testing of a gun assembly to be accomplished in a specifically designated safe area away from the well.

It is further an object of the invention to have a method and apparatus whereby all possible critical leak path connections in a gun assembly can be pressure tested, then not reopened prior to running into the wellbore.

SUMMARY OF THE INVENTION

The inventive apparatus consists of perforating gun "modules", each module consisting of a pressure test connector connected to each end of a perforating gun section (the perforating gun section consisting of one or more perforating guns connected together), whereby when each of the pressure test connectors is operably attached to each end of a perforating gun section, the pressure test connectors are capable of holding sufficient pressure to pressure test their respective perforating gun section. Once the pressure test connectors are attached, the perforating gun module is pressure tested. After the perforating module is tested, the pressure test connections are not removed. Instead, the gun assembly is constructed at the well site by connecting several previously tested perforating gun modules together, by operably connecting one of the pressure test connectors on a first perforating gun module to a pressure test connector on a second perforating gun module. As many additional perforating gun modules can be added to the gun assembly as desired.

Additionally, spacer modules may also be prepared in a manner similar to that used to prepare the perforating gun modules, and the spacer modules pressure tested. The prepared and tested spacer modules may also be included as components in the gun assembly.

An explosive transfer assembly is used to transfer the detonation signal from one module to the next. Thereby, by using perforating gun and spacer modules, the connection between the various gun and/or spacer modules in the gun assembly are not required to provide fluid-tight sealing, as they provide no leak path to the key components of the guns.

In a preferred embodiment, the pressure test connectors will allow the gun system to be fired in both directions (bottom-up or top-down) at the desired time by incorporating a bi-directional explosive transfer system. A benefit of such a feature is that if a gun does fire low order for any reason, the low order will likely be confined to one module, as the explosive transfer between guns is designed to fail in a low order situation and therefore stop the firing train.

In a preferred embodiment, the firing system may also use a pressure test connector similar to those used in the gun modules and be tested prior to deployment. The firing system may be connected directly to the guns or deployed later.

Using the inventive apparatus and method, all of the possible critical leak paths of the gun assembly may be tested prior to running into a well and thereby, the possibility of a damaging leak occurring within the assembly is virtually eliminated.

DESCRIPTION OF THE PREFERRED EMBODIMENT

Figure 1A:
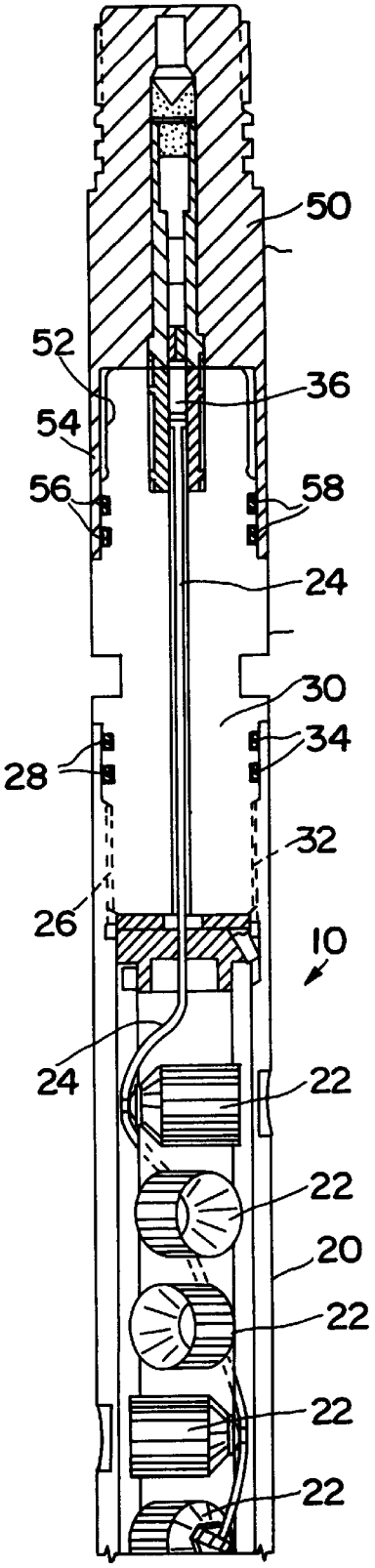
FIGS. 1A–1B is a longitudinal cross-sectional view of a perforating gun module utilizing the inventive concept.

In the description which follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like, as used herein, shall mean in relation to the bottom, or furthest extent of, the surrounding wellbore even though the wellbore or portions of it may be deviated or horizontal. Where components of relatively well known design are employed, their structure and operation will not be described in detail. The bi-directional firing assembly discussed herein is disclosed in U.S. Pat. No. 5,603,379 which is assigned to the assignee of this application, and incorporated in its entirety herein by reference.

Figure 1B:
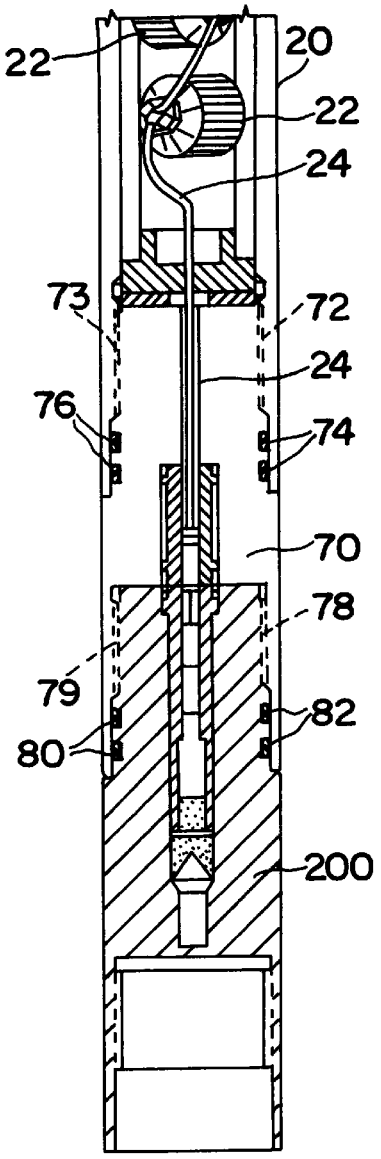

Referring now to FIGS. 1A–1B, a perforating gun module 10 utilizing the inventive concept is shown. More specifically, the gun module 10 comprises gun section 20, the gun section further comprising shaped charges 22 held in a helical configuration. Any other configuration pattern of charges as is well known in the art could be used with the inventive concept. While the perforating gun section 20 is shown as a single perforating gun in this preferred embodiment, it is to be understood that the gun section could consist of one, two, or more perforating guns connected together, as long as the finally constructed perforating gun module can be fitted into a pressure test chamber. The shaped charges are explosively connected via a detonation cord 24. The detonation cord is used to explosively transfer down the length of the gun section 20, thereby sequentially detonating each of the shaped charges 22 in rapid succession.

For illustration purposes, the inventive concept is being shown here with a fairly typical gun section. In fact, the inventive concept could be used with any type of perforating gun.

Further comprising the gun assembly is a first tandem connector 30, which is connected to the gun section 20. The tandem connector has threads 32 which are complementary to threads 26 on the gun section 20. Two o-rings 28 are seated in o-ring grooves 34, and are sealingly captured between the gun section 20 and the first tandem section 30 when the gun section and tandem section are screwed together. The connection between gun section threads 26 and tandem threads 32, along with the captured 0-rings 28, create a pressure-tight seal which will be tested during the pressure testing phase, such testing being described later.

The detonation cord 24 continues through the first tandem section 30, to provide a continuous path for the explosive transfer, being connected finally to a firing device 36.

The gun module 10 further comprises a second tandem section 70, which is connected to the other end of the gun section 20. The second tandem section 70 is similar to first tandem section 30. The tandem section 70 has threads 72 which are complementary to threads 73 on the gun section 20. Two o-rings 74 are seated in o-ring grooves 76, and are sealingly captured between the gun section 20 and the second tandem section 70 when the gun section and tandem section are screwed together. The connection between gun section threads 72 and tandem threads 73, along with the captured o-rings 74, create a pressure-tight seal which will be tested during the pressure testing phase, such testing being described later.

The gun module 10 further comprises a first pressure test connector 50, which is connected to the first tandem section 30. The first pressure test connector is connected by threads 52 which complementarily fit with threads 54 on the tandem. Two o-rings 56 are seated in grooves 58, and are sealingly captured between the gun section first pressure test connector 50 and the first tandem section 30 when the pressure test connector and the tandem section are screwed together. The connection between the first pressure test connector 50 and the first tandem section 30, along with the captured o-rings 56, create a pressure-tight seal which will also be tested during the pressure testing phase. The gun module 10 further comprises a second pressure test connector 200, which is connected to the second tandem section 70 in a similar fashion, and described in more detail later.

Figure 2:
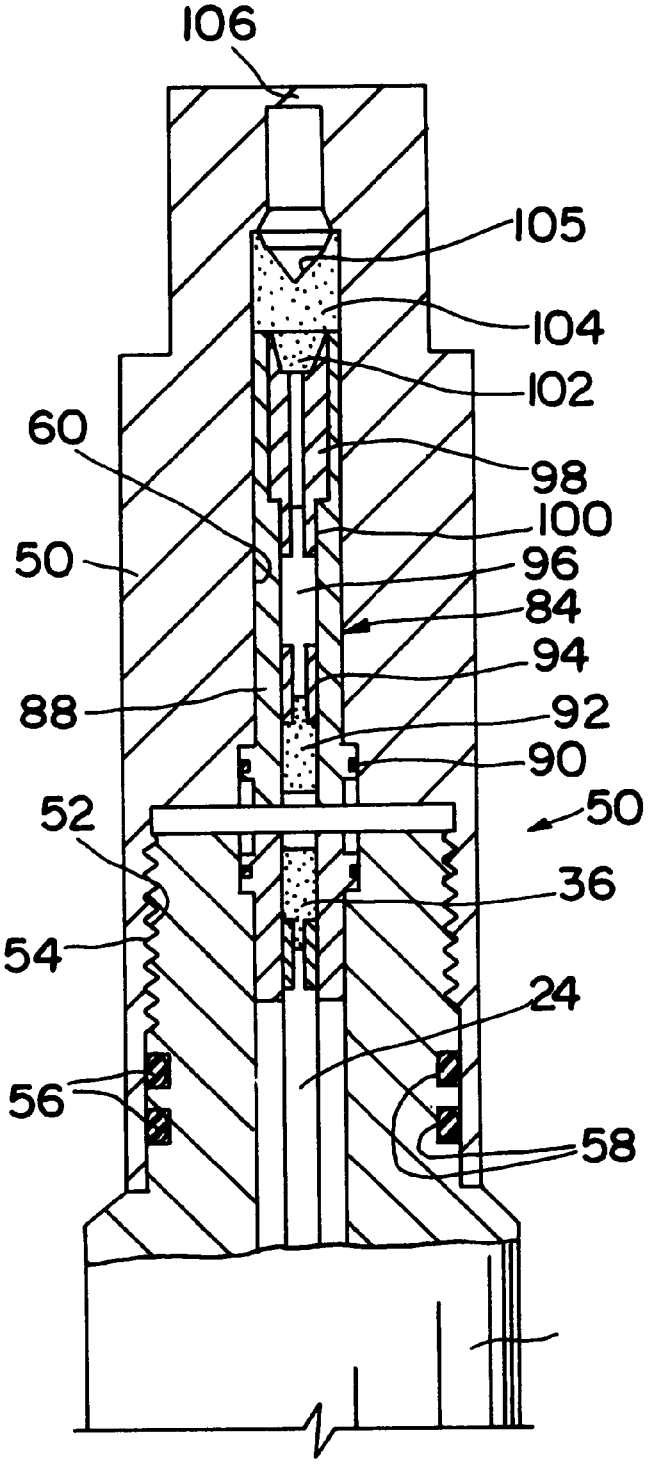
FIG. 2 is a longitudinal cross-sectional view of a first pressure test connector.

Referring now to FIG. 2, a first pressure test connector 50 is shown in greater detail. The first pressure test connector 50 defines a housing cavity 60 therein. Pressure test connector 50 has a wall portion 106 which closes the upper end of housing cavity 60. An explosive device 84 is disposed in housing cavity 60, and is adapted to provide an explosive transfer between gun modules.

Explosive device 84 comprises an insert 88 which is held in housing cavity 60 by a retaining means, such as the frictional engagement of an o-ring 90. A booster 92 is disposed in the lower end of insert 88. Booster 92 has a metallic portion 94 which is crimped around one end of a length of detonation cord 96. A detonation cord initiator 98 has a metallic portion 100 which is crimped around the other end of detonation cord 96. Detonation cord initiator 98 also includes a powder charge 102. A shaped charge 104 having a conical cavity 105 therein is positioned adjacent to charge 102.

Figure 3:
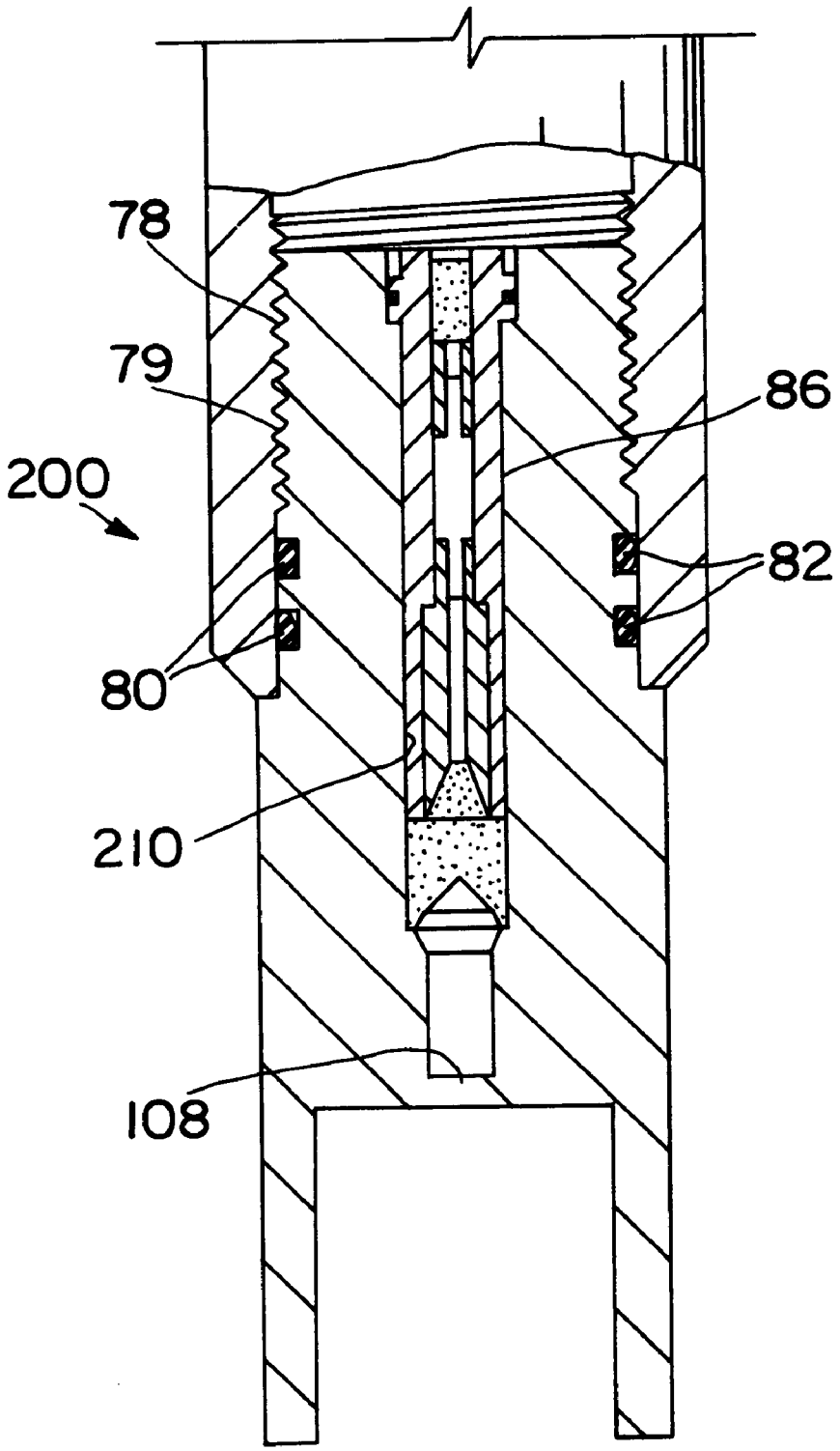
FIG. 3 is a longitudinal cross-sectional view of a second pressure test connector.

While the preferred embodiment is shown having a separate tandem section and pressure test connector, these two units could be manufactured together as a single unit. Referring now to FIG. 3, the second pressure test connector 200 is shown in greater detail. The second pressure test connector 200 has threads 78 which are complementary to threads 79 on the second tandem section 70. Two o-rings 80 are seated in o-ring grooves 82, and are sealingly captured between the second pressure test connector 200 and the second tandem section 70 when the second pressure test connector and tandem section are screwed together. The connection between pressure test connector threads 78 and tandem threads 79, along with the captured o-rings 80, create a pressure-tight seal which will be tested during the pressure testing phase, such testing being described later.

A second explosive device 86 is made of components substantially identical to the first explosive device 84 shown in FIG. 2. This second explosive device 86 is disposed in the second housing cavity 210 and is adapted for providing an explosive transfer between connecting pressure test connectors, thereby providing a bi-directional explosive path. While the explosive transfer assembly disclosed herein is substantially the same as disclosed in U.S. Pat. No. 5,603,379, any type of explosive transfer mechanism would work.

Again, while the preferred embodiment of the second pressure test connector 200 is shown being separate from the tandem section, they could be manufactured as a single pressure test connector.

Second pressure test connector 200 has a wall portion 108 which closes the lower end of housing cavity 210. Thus, when the first pressure test connector of one gun module is connected to the complementary pressure test connector of a second gun module, wall portions 106 and 108 are adjacent to one another. It will be seen that wall portions 106 and 108 separate housing cavities 60 and 210. In the preferred embodiment, but not by way of limitation, wall portions 106 and 108 are made of steel, and thus, provide a leak-proof steel barrier between first and second explosive devices 84 and 86. Hence, even if well fluids come between pressure test connectors 50 and 200, the guns will not be affected.

To conduct a pressure test on a gun module, the gun module is first assembled by threadedly connecting appropriate first and second tandem sections 30, 70 to the gun section 20, with o-rings 28,74 in place. Then first and second pressure test connectors 50, 200 are threadedly attached to their respective tandem sections, with o-rings 56, 80 in place. All these connections are torqued to appropriate levels. Then the entire gun module is placed in a test cell, and pressure tested, preferably with liquid. Once a gun module has passed pressure testing, the module is left intact and not disassembled, and is ready for running into the hole.

In a similar fashion, spacer modules can be prepared, the only difference being that the spacer modules have no shape charges, and are instead used to transfer the detonation to other gun or spacer modules further along.

Likewise, a firing system may also be prepared and pressure tested in a similar fashion. The firing system may be connected to the gun assembly as it is being inserted into the well, or added later after the rest of the gun assembly is in position in the hole.

Figure 4:
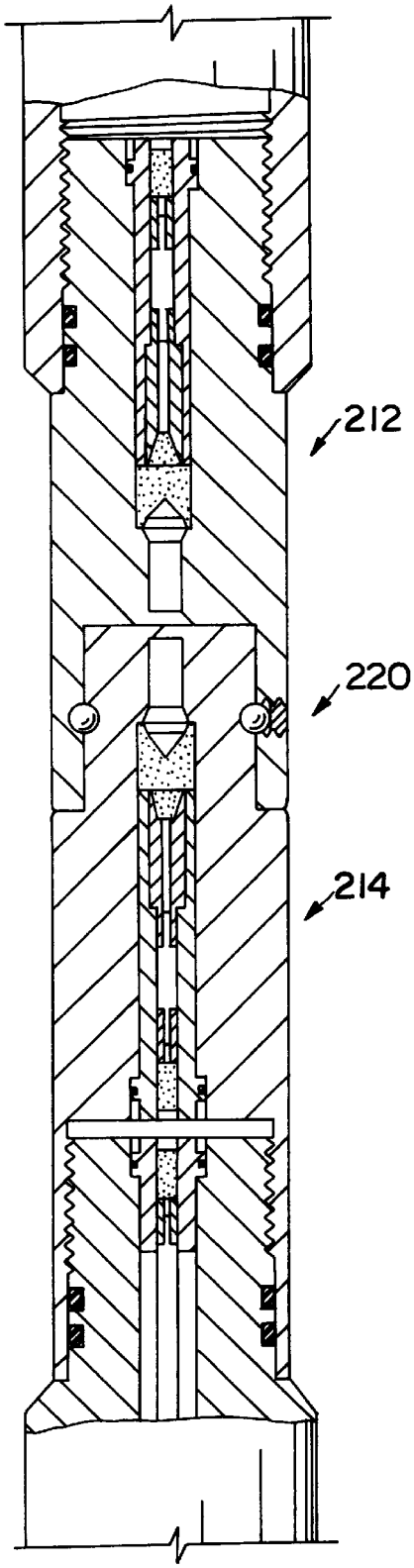
FIG. 4 is a longitudinal cross-sectional view of a two gun modules connected together.

When one is ready to construct a perforating gun assembly at the well site, the gun modules and/or spacer modules are connected together, as shown in FIG. 4. The modules 212 and 214 are shown connected by a swivel connection 220, as taught in detail in U.S. Pat. No. 5,603,379. The gun modules can also be connected via mutually complementary threads, or by any number of other means as are well known in the art. The only possible leak path will be at the connection between modules, and this leak path is of no importance, as it will not allow fluids to enter the modules, or to thereby affect the guns. Hence, the modules, and thereby the entire gun assembly, are pressure safe.

Thus, the invention is able to meet all the objectives described above. The foregoing description and drawings of the invention are explanatory and illustrative thereof, and various changes in sizes, shapes, materials, and arrangement of parts, as well as certain details of the illustrated construction, may be made within the scope of the appended claims without departing from the true spirit of the invention. Accordingly, while the present invention has been described herein in detail to its preferred embodiment, it is to be understood that this disclosure is only illustrative and exemplary of the present invention and is made merely for the purposes of providing and enabling disclosure of the invention. The foregoing disclosure is neither intended nor to be construed to limit the present invention or otherwise to exclude any such embodiments, adaptations, variations, modifications, and equivalent arrangements, the present invention being limited only by the claims appended hereto and the equivalents thereof.

We claim:

1. A method for preparing a perforating gun assembly for insertion into and use in a wellbore, the assembly comprising at least a first and a second perforating gun module, each of the modules having a first and a second end, the method comprising:

creating each perforating gun module by taking a perforating gun section that has a first and a second end, and operably attaching a first pressure test connector to the first end of the perforating gun section and operably attaching a second pressure test connector to the second end of the perforating gun section, whereby when the pressure test connectors are operably attached to each end of the perforating gun section, the pressure test connectors are capable of holding sufficient pressure for pressure testing of the complete perforating gun module;

pressure testing each of the perforating gun modules; and then connecting the perforating gun modules together by operably connecting one of the pressure test connectors on the first perforating gun module to one of the pressure test connectors on the second perforating gun module, without breaking any pressure-bearing seal of the gun modules between the pressure testing step and the connecting step.

2. The method of claim 1, wherein the gun assembly further comprises a firing system.

3. The method of claim 2, wherein the firing system is added to the gun assembly after the gun assembly is already lowered into position for firing in the wellbore.

4. The method of claim 2, wherein the firing system is added to the gun assembly as it is being prepared for insertion into the wellbore.

5. The method of claim 1, wherein the gun assembly further comprises at least one spacer module, the method further comprising:

creating the at least one spacer module by taking a spacer section having a first and a second end, and operably attaching a first pressure test connector to a first end of the spacer section and a second pressure test connector to the second end of the spacer section, whereby when the pressure test connectors are operably attached to each end of the spacer section, the pressure test connectors are capable of holding sufficient pressure for pressure testing of the complete spacer module;

pressure testing the at least one spacer module; and, connecting the spacer module together with the perforating gun modules by operably connecting one of the pressure test connectors on the first perforating gun module to one of the pressure test connectors on the spacer portion, and operably connecting one of the pressure test connectors on the second perforating gun module to the second pressure test connector on the spacer module.

6. The method of claim 1, wherein the step of creating the perforating gun modules further comprises inserting tandem connectors between each of the pressure test connectors and their respective perforating gun section, each tandem section comprising detonation cord and a firing device.

7. The method of claim 1, wherein the perforating gun modules further comprise an explosive transfer assembly.

8. The method of claim 6, wherein the tandem connectors further comprise explosive transfer assemblies.

9. The method of claim 1, wherein the step of operably connecting the modules together is accomplished by threaded connections.

10. The method of claim 1, wherein the step of operably connecting the modules together is accomplished by a swivel joint.

11. A method for preparing a perforating gun module for insertion into and use in a wellbore, the method comprising:

creating a perforating gun module by taking a perforating gun section that has a first and a second end, and operably attaching a first pressure test connector to the first end of the perforating gun section and operably attaching a second pressure test connector to the second end of the perforating gun section, whereby when the pressure test connectors are operably attached to each end of the perforating gun section, the pressure test connectors are capable of holding sufficient pressure for pressure testing of the complete perforating gun module;

pressure testing the perforating gun module; and then inserting and using the perforating gun module in the wellbore without removing the pressure test connectors between the pressure testing step and the inserting step.

12. The method of claim 11, wherein the step of creating the perforating gun modules further comprises inserting tandem connectors between each of the pressure test connectors and the perforating gun section, each tandem section comprising detonation cord and a firing device.

13. The method of claim 11, wherein the perforating gun module further comprise an explosive transfer assembly.

14. The method of claim 12, wherein the tandem connectors further comprise explosive transfer assemblies.

15. A method for preparing a spacer module for insertion into and use in a wellbore, the method comprising:

creating the spacer module by taking a spacer section that has a first and a second end, and operably attaching a first pressure test connector to the first end of the spacer section and operably attaching a second pressure test connector to the second end of the spacer section, whereby when the pressure test connectors are operably attached to each end of the spacer section, the pressure test connectors are capable of holding sufficient pressure for pressure testing of the complete spacer module;

pressure testing the spacer module; and then inserting and using the spacer module in the wellbore without removing the pressure test connectors between the pressure testing step and the inserting step.

16. The method of claim 15, wherein the step of creating the spacer modules further comprises inserting tandem connectors between each of the pressure test connectors and the perforating gun section, each tandem section comprising detonation cord and a firing device.

17. The method of claim 15, wherein the spacer module further comprise an explosive transfer assembly.

18. The method of claim 16, wherein the tandem connectors further comprise explosive transfer assemblies.

19. A method of delivering a pressure tested explosive assembly into a wellbore, the method comprising the steps of:

providing the assembly including multiple individual explosive modules, each of the modules including at least one pressure-bearing seal;

pressure testing each of the modules; and then interconnecting the modules to each other to thereby form the assembly, without breaking any of the pressure bearing seals of the modules between the pressure testing step and the interconnecting step.

20. The method according to claim 19, wherein in the providing step, each of the modules has at least one pressure test connection attached at an end of the module, and wherein the interconnecting step is performed without removing any pressure test connections from the modules.

21. A method of delivering a pressure tested explosive assembly into a wellbore at a wellsite, the method comprising the steps of:

pressure testing multiple explosive modules of the assembly at a location remote from the wellsite;

transporting the pressure tested modules to the wellsite;

then interconnecting the modules to form the assembly; and then installing the assembly in the wellbore, without breaking any pressure bearing seal of any of the modules between the pressure testing step and the installing step.

22. A method of delivering a pressure tested explosive assembly into a wellbore at a wellsite, the method comprising the steps of:

pressure testing multiple explosive modules of the assembly at a location remote from the wellsite, each of the modules having at least one pressure test connection attached thereto during the pressure testing step;

transporting the pressure tested modules to the wellsite;

then interconnecting the modules to form the assembly, without removing the pressure test connections from the modules; and then installing the assembly in the wellbore.

* * * * *